US006234421B1

(12) United States Patent
Cox et al.

(10) Patent No.: US 6,234,421 B1
(45) Date of Patent: May 22, 2001

(54) REEL HAVING SECURED FLANGES

(75) Inventors: Gary L. Cox, Richmond, IN (US); Peter M. Blackford, Naples, FL (US); Jack E. Elder, Rochester, MI (US)

(73) Assignee: Vandor Corporation, Richmond, IN (US)

( * ) Notice: Subject to any disclaimer, the term of this patent is extended or adjusted under 35 U.S.C. 154(b) by 0 days.

(21) Appl. No.: 09/411,946

(22) Filed: Oct. 4, 1999

Related U.S. Application Data

(63) Continuation of application No. 08/924,155, filed on Sep. 5, 1997, now abandoned.
(60) Provisional application No. 60/029,113, filed on Oct. 24, 1996.

(51) Int. Cl.[7] ..... B65H 75/14
(52) U.S. Cl. ..... 242/608.8; 242/588; 242/610.4
(58) Field of Search ..... 242/608.7, 608.8, 242/118.61, 610.3, 610.4, 608, 608.2, 614, 129.51, 588

(56) References Cited

U.S. PATENT DOCUMENTS

| | | |
|---|---|---|
| 889,109 | 5/1908 | Davidson . |
| 922,695 | 5/1909 | Haas . |
| 1,542,611 | 6/1925 | Clark . |
| 2,605,980 | 8/1952 | Atwood et al. . |
| 2,622,825 | 12/1952 | Faris . |
| 2,799,458 | 7/1957 | Nye . |
| 2,822,992 | 2/1958 | Moulden . |
| 2,823,573 | 2/1958 | Vasikonis et al. . |
| 2,881,987 | 4/1959 | Atwood et al. . |
| 2,991,958 | 7/1961 | Eifrid . |
| 3,114,495 | 12/1963 | Grooms . |
| 3,278,135 | 10/1966 | Black . |
| 3,352,410 | 11/1967 | Salladay et al. . |
| 3,544,032 | 12/1970 | Faulkner . |
| 3,661,341 | 5/1972 | Eifrid . |
| 3,680,810 | 8/1972 | Jarmalow . |
| 3,876,073 | 4/1975 | Herbetko . |
| 3,958,775 | 5/1976 | Liga . |
| 4,244,254 | 1/1981 | Fish . |
| 4,817,796 | 4/1989 | Camillo et al. . |
| 4,884,690 | 12/1989 | Klenter et al. . |
| 4,995,512 | 2/1991 | Liebel . |
| 5,203,516 | 4/1993 | Donaldson . |
| 5,529,126 | 6/1996 | Bass . |

OTHER PUBLICATIONS

Canadian Patent No. 647,592, issued Aug. 28, 1962.
GMC–Genpak Spool and Reel References Brochure, (at least as early as Jan. 20, 1996).

*Primary Examiner*—John Q. Nguyen
(74) *Attorney, Agent, or Firm*—Maginot, Addison & Moore

(57) ABSTRACT

An apparatus for supporting wound flexible media includes a core, first and second flanges, and at least one locking ring. The core has first and second ends, an inner surface and an outer surface. The first flange, which attaches to the first end of the core, includes a first plurality of flexible fingers that extend axially inward the core adjacent to said inner surface proximate the first end. Likewise, the second flange, which attaches to the second end of the core, includes a second plurality of flexible fingers that extend axially inward the core adjacent to said inner surface proximate the second end. The locking ring urges the first plurality of flexible fingers to the inner surface proximate the first end.

23 Claims, 7 Drawing Sheets

REEL HAVING SECURED FLANGES

CROSS REFERENCE TO RELATED APPLICATION

This application is a continuation of U.S. patent application Ser. No. 08/924,155, filed Sep. 5, 1997, abandoned, and also claim benefit of 60/029,113 filed Oct. 24, 1996.

FIELD OF THE INVENTION

The present intention relates generally to reels for supporting or storing flexible media.

BACKGROUND OF THE INVENTION

Reels for storing flexible media, such as wire, hose, fabric, chain link, or rope, typically comprise a core interposed between two flanges. In general, the flexible media is wound or wrapped around the core and held in place by the flanges. Reels that are intended for industrial transport, storage and use of flexible media vary greatly in size. Reels have traditionally been fabricated out of wood or metallic material, and have more recently been fabricated from paper and plastic products.

Ideally, a reel combines structural strength with convenience and economy of manufacture. One development in the reel industry that has increased convenience is the rotating reel assembly. A rotating reel assembly is a reel that is rotatably connected to a frame structure and is typically enclosed in a box. The rotating reel assembly permits the user of the flexible media payload to pay-out the flexible media at any location without the need for special fixtures on which to mount the reel.

For example, the Reel In A Box product from Carris Reels is a rotating reel assembly within a box that may be used at any suitable location. An end user simply places the box in the location in which the flexible media, for example, cable, is needed. The cable may then be started through an opening in the box and paid out as the reel rotates within box. To facilitate pay out within the box, the reel is rotatably connected to frame within the box. The frame supports and allows free rotation of the reel within the box.

One drawback of the Carris Reel in a Box and other presently available products is that the are constructed predominantly of non-paper materials, such as wood, metal, or plastic. Paper materials are advantageous in reel construction because paper has a better strength to weight ratio than plastics, wood and metal, and therefore is less expensive to transport and easier to manipulate. Moreover, paper products are is generally easier to recycle. The Carris Reel is a Box loses such advantages by relying predominantly on non-paper materials.

Another currently available rotating reel assembly, the Easy-Reel™ product from Genpak, utilizes a reel made substantially from corrugated and/or pressed paper. While the use of paper products reduces weight and is generally easier to recycle, the Easy-Reel™ product has other significant shortcomings. For example, the Genpak reel has structural weaknesses in the attachment of the flanges to the core. Specifically, the Genpak reel uses a plastic hub that connects a paper flange to a paper core. The attachment of the flange to the core relies on a plastic to paper interface, which presumably is glued. Plastic to paper glue bonds can be relatively weak. The Genpak reel also includes a small paper to paper interface consisting of the inner radial edge of the flange and the outside of the core. However, the inner radial edge of the flange provides very little paper surface area to provide the structural attachment of the flange to the core. As a result, the attachment of the flange to the core has limited structural integrity.

Another shortcoming of the Genpak reel is that it must be loaded to a box to be functional. Specifically, the only feature that holds the stationary reel frame to the rotating reel is the box itself. The stationary reel frame consists of two individual end plates that are held in place by the box. Without the box, the end plates may freely migrate axially out from the reel. As a result, loading the reel is an inconvenient process. In particular, a reel must first be loaded, and then carefully assembled onto the frame and placed within the box while holding the frame against the reel. Such a process is undesirable because of the difficulties associated with manipulating a loaded, and typically heavy reel.

A need therefore exists for a lightweight reel that has a structurally strong means by which the flanges are attached to the core. A further need exists for a rotating reel assembly that features such a lightweight and structurally sound reel. Yet a further need exists for a rotating reel assembly that does not require a box to secure the stationary reel frame to the rotating reel.

SUMMARY OF THE INVENTION

The present invention fulfills the above stated needs, as well as others, by providing a reel comprising a core, and two flanges, each flange having a plurality of flexible fingers for engaging the core to help secure the flange to the core. The plurality of flexible fingers on the flanges increase the surface area of the flange that engages the core, thereby strengthening the connection between each flange and the core. The increased engagement surface area allow the use of predominantly paper materials in a structurally strong reel.

In one embodiment of the present invention, an apparatus for supporting wound flexible media includes a core, first and second flanges, and at least one locking ring. The core has first and second ends, an inner surface and an outer surface. The first flange, which attaches to the first end of the core, includes a first plurality of flexible fingers that extend axially inward the core adjacent to said inner surface proximate the first end. Likewise, the second flange, which attaches to the second end of the core, includes a second plurality of flexible fingers that extend axially inward the core adjacent to said inner surface proximate the second end. The locking ring urges the first plurality of flexible fingers to the inner surface proximate the first end. A second locking ring may also be employed to urge the second plurality of flexible fingers to the inner surface proximate the second end.

The resulting structure provides a strong attachment of each flange to the core, particularly for reels in which the core and flanges are constructed of paper products. Another aspect of the present invention is a rotating reel assembly that incorporates the above reel. The rotating reel assembly includes the a reel having a similar structure as that described above wherein the at least one locking ring is part of at least one hub. The at least one hub also includes at least one rotating bearing. The rotating reel assembly according to the present invention further includes a frame, the frame including at least one static bearing for rotatably engaging the at least one rotating bearing to permit the reel to rotating with respect to the frame. In a preferred embodiment, the static bearing includes an axial retention surface for inhibiting axial movement of the static bearing with respect to the dynamic bearing. The axial retention surface facilitates retention of the frame to the reel, thereby allowing full use of the rotating reel assembly without a box to hold the assembly together.

The present invention thus provides a structurally strong reel that may be constructed out of predominantly paper materials. As a result, the advantages of paper reels may be exploited without the structural weakness typically associated with the core-flange attachment in such reels.

The above features and advantages, as well as others, will become readily apparent to those of ordinary skill in the art by reference to the following detailed description and accompanying drawings.

DETAILED DESCRIPTION

Figure 1:
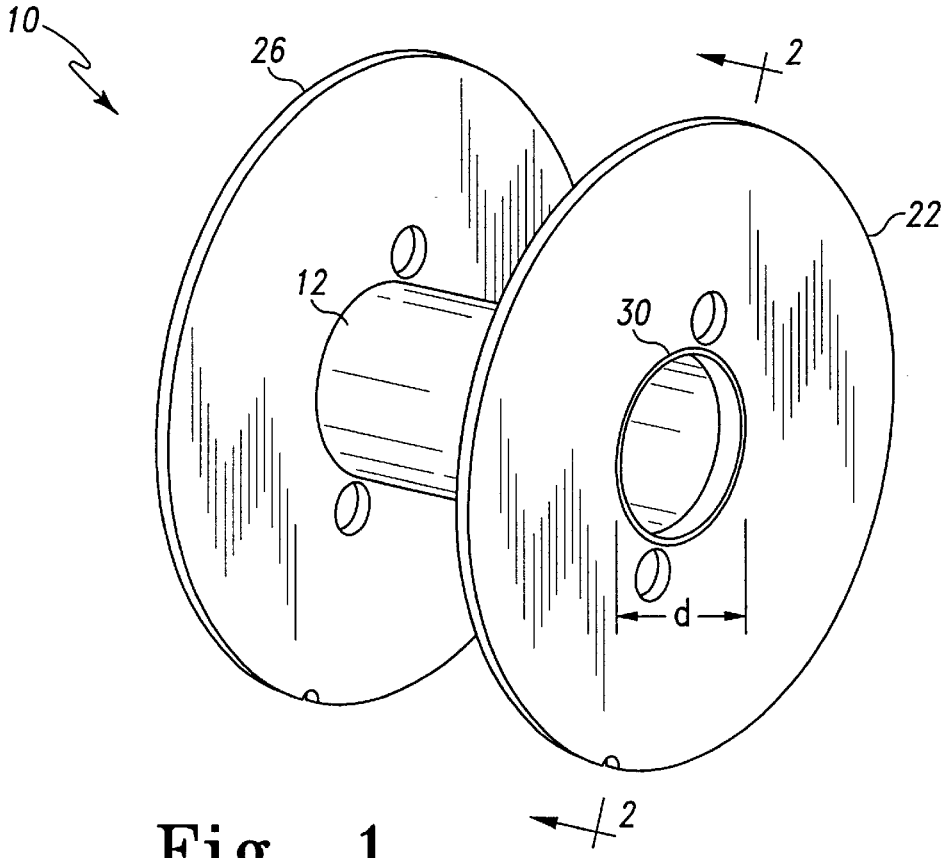
FIG. 1 illustrates an elevational perspective view of an exemplary reel in accordance with the present invention.

FIG. 1 illustrates an elevational perspective view of an exemplary first embodiment of a reel in accordance with the present invention. The reel 10 comprises a core 12, first and second flanges 22 and 26, respectively, and at least one locking ring 30 that serves as a hub. As will be described in further detail in connection with FIGS. 2, 3 and 4, the first and second flanges 22 and 26, respectively, each include a plurality of flexible fingers. The at least one locking ring 30 tightly fits into the core to trap the plurality of flexible fingers adjacent to the interior of the core 12.

Figure 2:
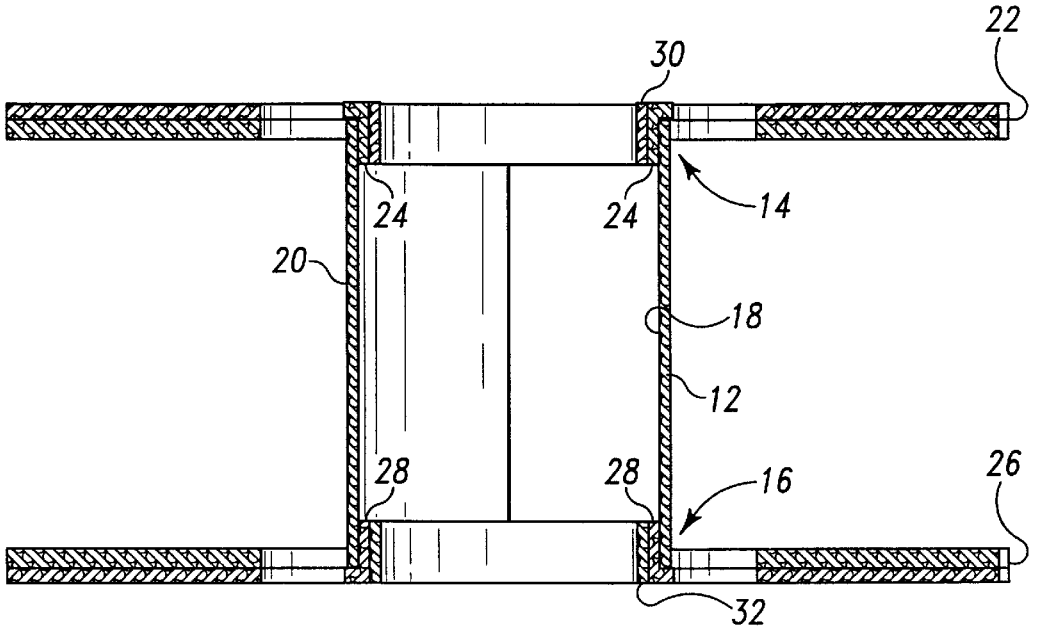
FIG. 2 illustrates a cross sectional side view (not to scale) of the reel in FIG. 1.
Figure 3:
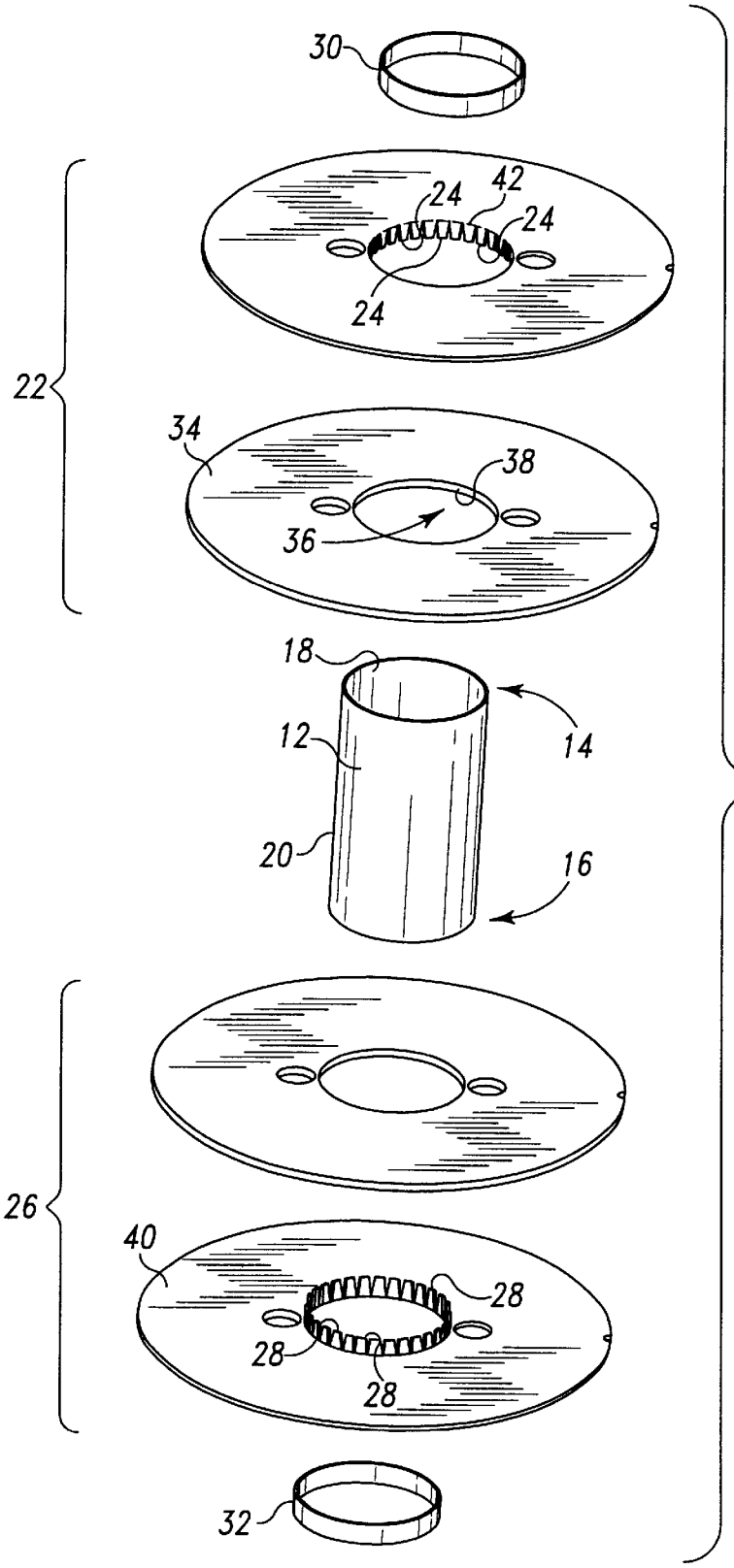
FIG. 3 illustrates an exploded perspective view (not to scale) of the reel in FIG. 1.

Reference is made to FIGS. 2 and 3, which illustrate in detail the reel 10 of FIG. 1. FIG. 2 illustrates a cross sectional side view (not to scale) of the reel 10, and FIG. 3 illustrates an exploded perspective view (not to scale) of the reel 10.

The core 12 has a first end 14 and a second end 16 axially separated by the body of the core 12. The core 12 includes a inner surface 18 and an outer surface 20. In the first embodiment, the core 12 is preferably a hollow cylindrical structure constructed of rigid pressed paper material. While the use of a cylindrical structure has certain advantages, such as simplicity of manufacture, the core 12 may alternatively have a non-cylindrical structure, such as a hollow or partially hollow structure having a polygonal or elliptical cross section.

Figure 4:
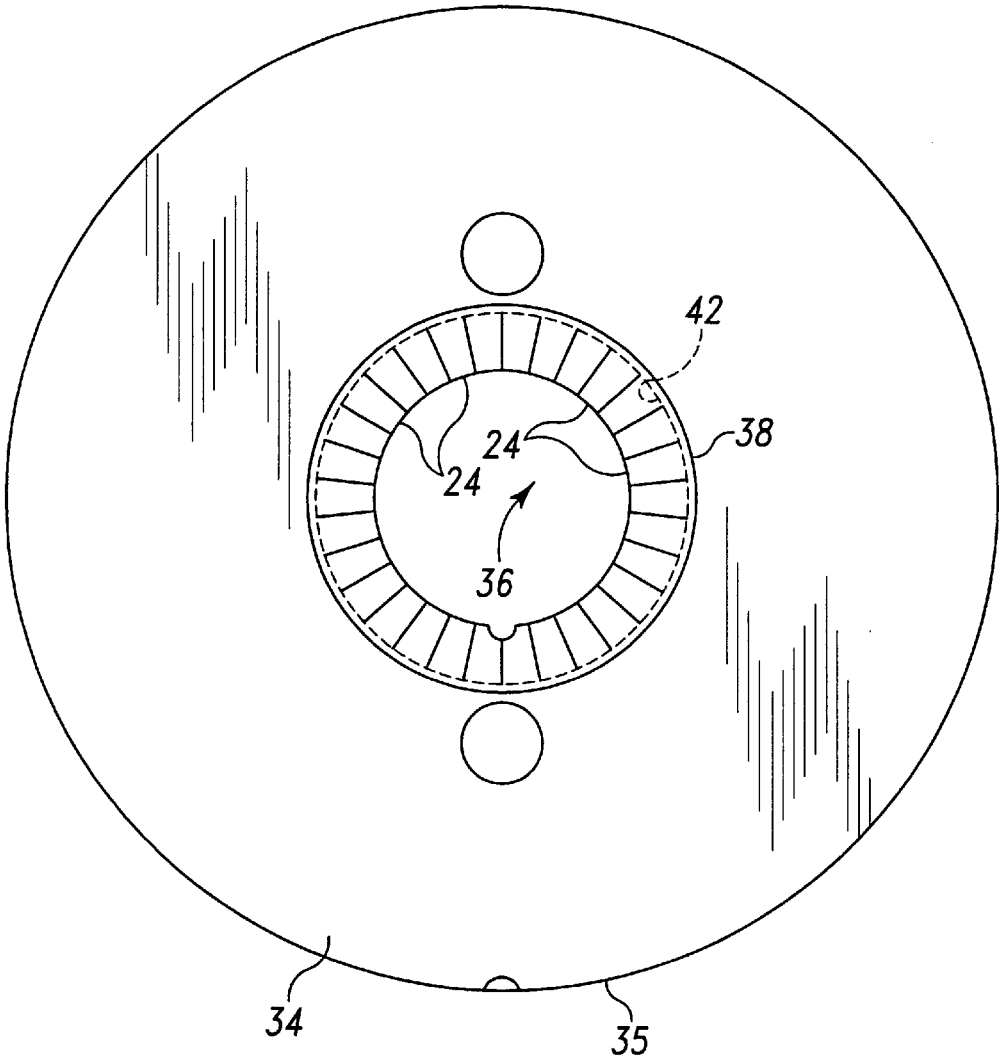
FIG. 4 illustrates a flange for use in a reel according to the present invention.

In any event, the first flange 22 attaches to the core 12 via a first plurality of flexible fingers 24. Reference is additionally made to FIG. 4, which illustrates a top view of the first flange 22 apart from the reel 10. The first flange 22 comprises a plate-like annulus having an outer perimeter 35 and a center hole 36. Although the general circular or annular shape of the first flange 22 is preferred, other shapes may readily be used, such as elliptical or polygonal shapes. The first flange 22 comprises an inner plate 34 and an outer plate 40. The inner plate 34 includes an inner radial edge 38 that defines the center hole 36 and engages the outer surface 20 of the core 12 (See FIGS. 2 and 3). The outer plate 40 includes a fold annulus 42 which defines a ring that is in registration with the inner surface 18 of the core 12 (See FIGS. 2 and 3).

As shown in FIGS. 3 and 4, prior to assembly, the first plurality of flexible fingers 24 extends radially inward the fold radius 42. The first plurality of flexible fingers 24 are typically integrally formed with at least a portion of the annulus of the first flange 22 and in this case, the outer plate 40. In a preferred embodiment, the first flange 22 is constructed of corrugated paper and the first plurality of flexible fingers 24 are formed by die cutting a series of annularly spaced, radial cuts extending inward from the fold radius 42 of the outer plate 40. Once the reel 10 is assembled, the first plurality of flexible fingers 24 extend axially inward the core 12, approximately perpendicular to the radial plane of the annulus of first flange 22 (see FIG. 2).

The second flange 26 preferably has substantially the same structure as the first flange 22, and includes a second plurality of flexible fingers 28 formed in the same manner as the first plurality of flexible fingers 24.

In the first embodiment, first locking ring 30 and a second locking ring 32 each comprise a hub that secures the flexible fingers 24 and 28 to the inner surface 18 of the core 12. Specifically, the first locking ring 30 urges and secures the first plurality of flexible fingers 24 to the inner surface 18 proximate the first end 14, and the second locking ring 32 urges and secures the second plurality of flexible fingers 28 to the inner surface 18 proximate the second end 16. To this end, the first locking ring 30 and second locking ring 32 preferably have dimensions slightly smaller than, but generally defining, the inner surface 18 of the core 12. The first and second locking rings 30 and 32, respectively, may suitably be constructed of pressed paper or other paper material, plastic, wood, metal or a composite material. The use of paper for the first and second locking rings 30 and 32 provide the advantage of an all paper construction when the core 12 and flanges 22 and 26 are also constructed of paper.

During assembly, the first flange 22 is located adjacent to the first end 14 of the core 12 such that the radial edge 38 fits over the outer surface 20 of the core 12. The first plurality of flexible fingers 24 are then forced axially inward the first end 14 of the core 12. In a preferred assembly method, the first locking ring 30 is used to force the first plurality of flexible fingers 24 into the core 12. In other words, after the first flange 22 is located adjacent to the first end 14 of the core 12 as described above, the first locking ring 30 is positioned atop the first flange 22 in registration with the inner surface 18 of the core 12, which is also in substantial registration with the fold annulus 42 of the first flange 22. The first locking ring 30 is then forced into the core 12, which causes the first plurality of flexible fingers 24 to bend at the fold radius 42. As the first locking ring 30 is forced into the core 12, the first plurality of flexible fingers 24 are forced against the inner surface 18.

For increased strength, an adhesive is applied to either the first plurality of locking fingers 24 or the inner surface 18 proximate the first end 14 of the core 12 to secure the first plurality of locking fingers 24 to the inner surface 18. The first locking ring 30 may also be treated with an adhesive to secure the first hub 30 to the plurality of flexible fingers 24.

The second flange 26 is secured to the core 12 in the same general manner. Specifically, the second flange 26 is positioned adjacent to and in registration with the second end 16 of the core 12. The second locking ring 32 is positioned atop the second flange 26 in registration with the inner surface 18 of the core 12. The second locking ring 32 is then forced into the core 12, which forces the second plurality of flexible fingers 28 into the core 12 against the inner surface 18. As before, an adhesive may be applied to either the second plurality of locking fingers 28 or the inner surface 18 proximate the second end 16 of the core 12 to secure the second plurality of locking fingers 28 to the inner surface 18. The second locking ring 32 may also be treated with an adhesive to secure the second locking ring 32 to the second plurality of flexible fingers 28.

The resulting reel 10 has increased structural strength over prior art paper-based reels. While prior art reels relied upon small paper to paper gluing surfaces, or plastic to paper gluing surfaces, the present invention provides a large paper to paper gluing or adhesive surface between the flanges 22 and 26 and the core 12. Moreover, by tightly fitting the hubs or locking rings 30 and 32 to the inner surface 18 of the core 12, a structurally sound reel 10 may optionally be constructed without the use of adhesive.

The reel 10 may readily be incorporated into a rotating reel assembly by adding a frame, not shown, that includes an axle or static bearings which engage and allow rotational movement of the first and second locking rings 30 and 32, respectively. Alternatively, the reel 10 may be used as a stand-alone reel.

Figure 5:
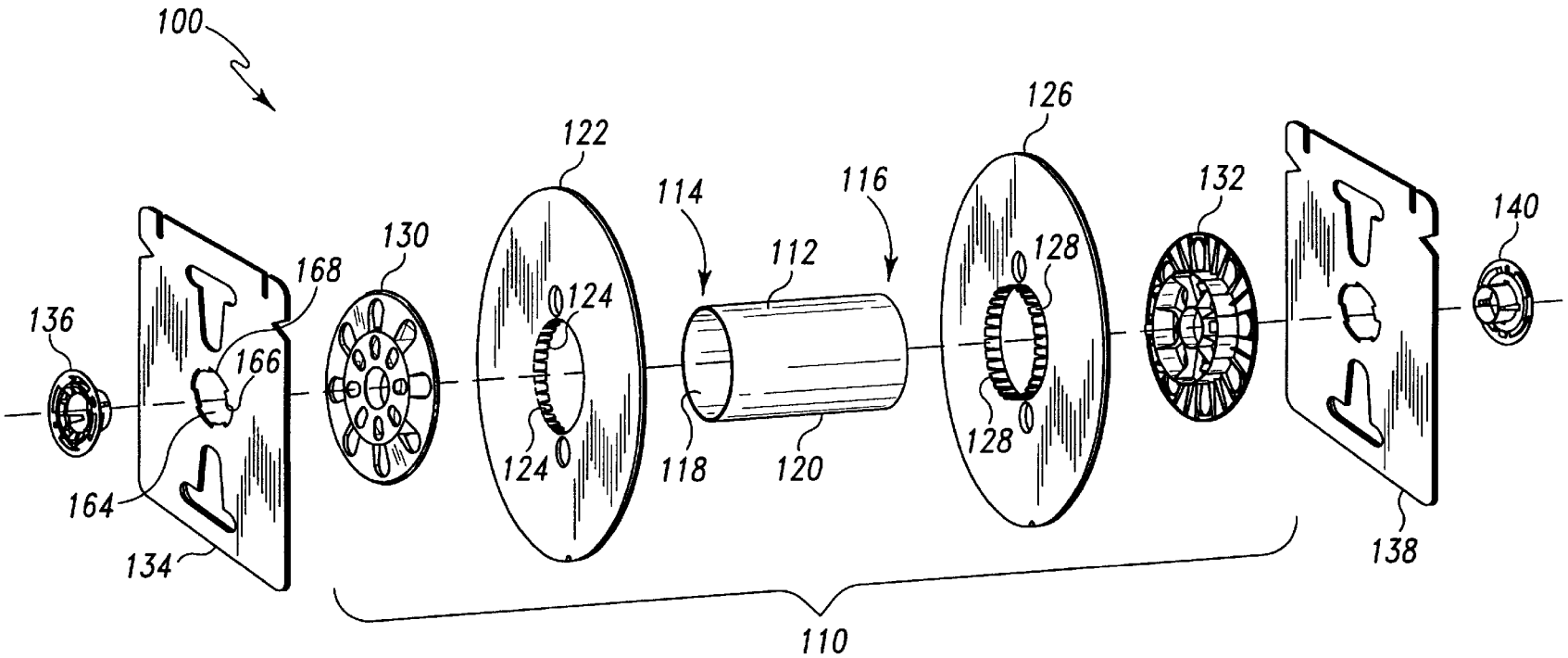
FIG. 5 illustrates an exploded perspective view of a second embodiment of a reel according to the present invention in a rotating reel assembly according to the present invention.
Figure 6:
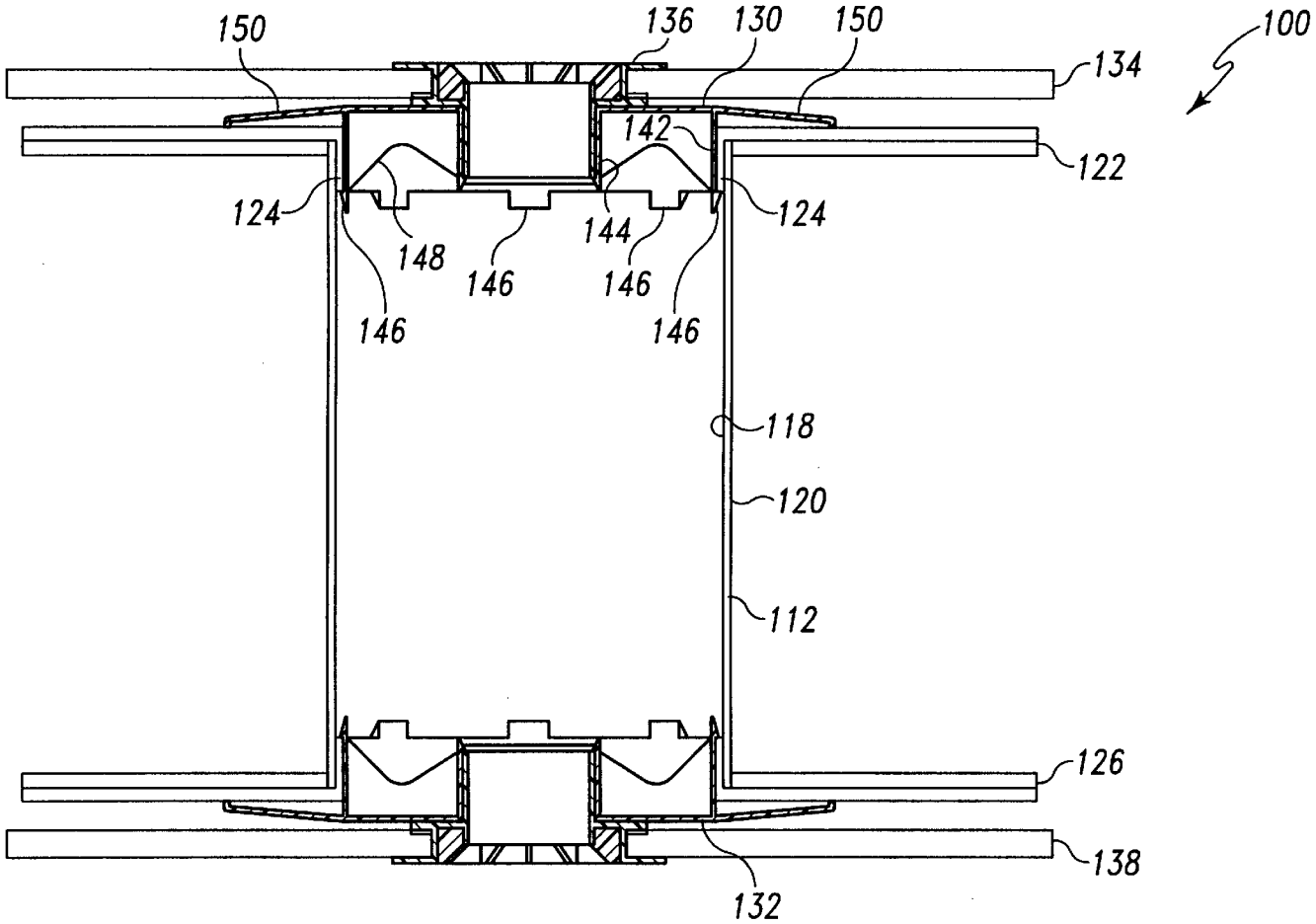
FIG. 6 illustrates a cross sectional side view of the rotating reel assembly of FIG. 5.

FIGS. 5 and 6 illustrate a second embodiment of a reel 100 according to the present invention in a rotating reel assembly 100 according to the present invention. The reel 110 incorporates the features and advantages of the reel 10 of FIGS. 1 through 4, but uses an alternative hub structure that provides further advantages when used in a rotating reel assembly. FIG. 5 illustrates an exploded perspective view of the reel 110 and the rotating reel assembly 100, and FIG. 6 illustrates a cross sectional side view of the reel 110 and rotating reel assembly 100.

The rotating reel assembly 100 consists of the reel 110 rotatably mounted on a frame. The frame in the embodiment described in FIGS. 5 and 6 includes a first end plate 134, a first static bearing 136, a second end plate 138, and a second static bearing 140. The reel 110 comprises a core 112 interposed between a first flange 122 and a second flange 126. The core 112 and the flanges 122 and 126 may suitably have the same structure as the core 12 and flanges 22 and 26, respectively, of FIGS. 1, 2, 3 and 4.

Figure 8B:
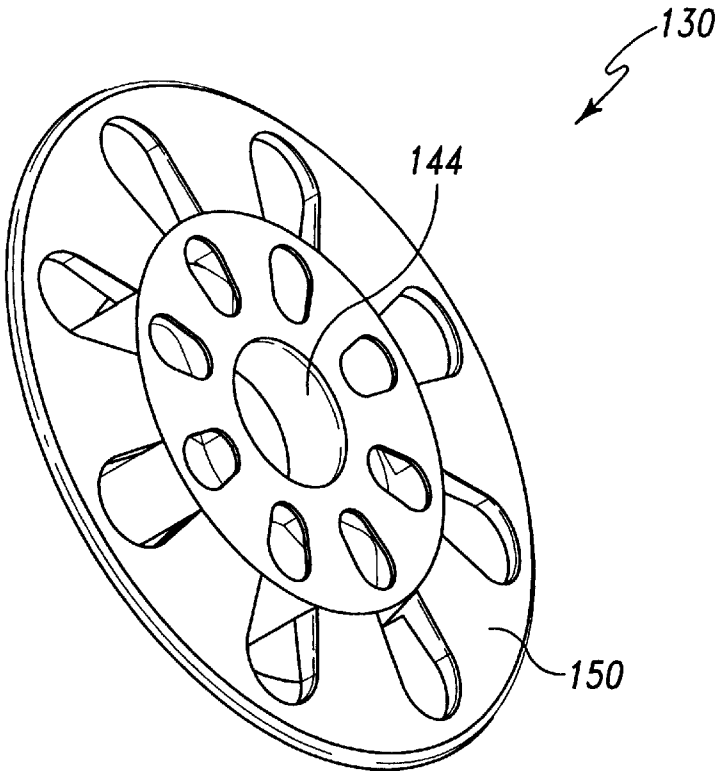
FIGS. 8A and 8B illustrate first and second perspective views of a hub including a dynamic bearing for use in the rotating reel assembly of FIG. 5.
Figure 8A:
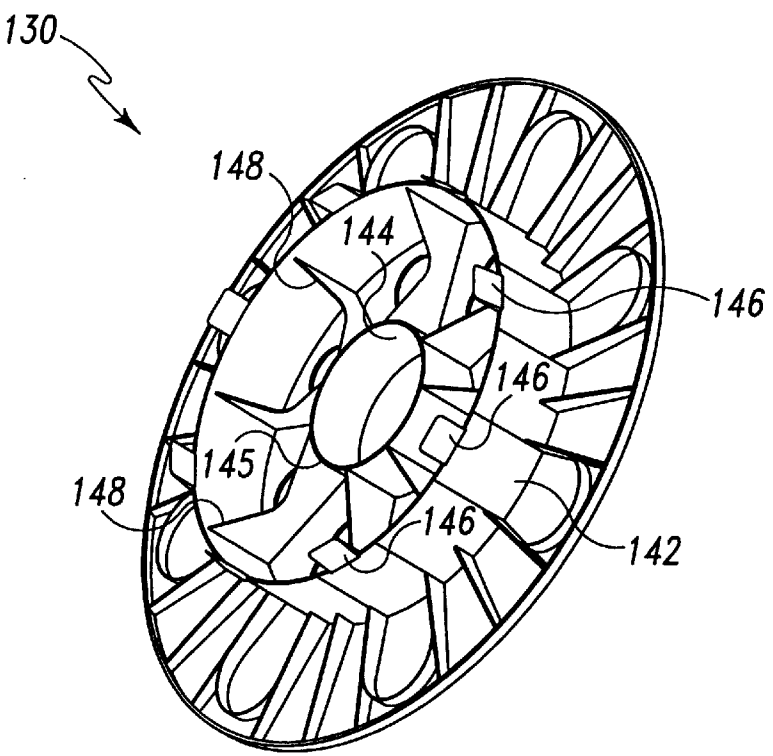

The reel 110 further comprises a first hub 130 and a second hub 132. FIGS. 8A and 8B illustrate first and second perspective views of a hub including a dynamic bearing. Specifically, FIGS. 8A and 8B illustrate the first hub 130 apart from the rotating reel assembly 100. of FIGS. 5 and 6. The second hub 132 preferably has substantially the same structure as the first hub 130.

Referring to FIGS 6, 8*a* and 8*b*, the first hub 130 includes a disk-shaped, radially sloped reinforcement portion 150. The reinforcement portion 150 extends radially adjacent the first flange 122 to provide structural support thereto (see FIG. 6). The first hub 130 further includes a substantially cylindrical dynamic bearing 144 that extends axially from and defines an inner radius of reinforcement portion 150. The dynamic bearing 144 terminates in an inner axial edge 145. The first hub 130 is preferably constructed of a plastic material. The use of plastic material for the first hub 130 provides for improved reel rotation and still permits the reel 110 to otherwise be constructed predominantly of paper.

The first hub 130 further includes a substantially cylindrical locking ring 142 disposed radially outward the dynamic bearing 144 and which extends axially from the reinforcement portion 150. The locking ring 142 has a radius substantially defined by the inner surface 118 of the core 112, and includes a plurality of locking ring barbs 146. As shown in FIG. 6, the each of the plurality of locking ring barbs 146 engage the axially innermost edge of at least one of the first plurality of flexible fingers 124 of the first flange 122. In a preferred embodiment, each of the plurality of locking ring barbs 146 is wedge-shaped member having a radially inward side flush with the locking ring 142 and a radially outward side defining a protrusion from the locking ring 142.

The plurality of locking ring barbs 146 secure the first hub 130 to the core 112 and/or first flange 122. The first plurality of flexible fingers 124 are typically secured to the inner surface 118 with an adhesive. The locking ring barbs 146 engagement with the first plurality of flexible fingers 124 within the core 112 inhibit axial motion of the first hub 130 with respect to the first flange 122.

In contrast to the prior art, which relied on either adhesives, radial friction, or a combination thereof to secure a plastic hub to the flange, the reel 110 of the present invention utilizes an axial engagement surface between the barbs 146 and the flexible fingers 124 to secure the first hub 130 to the first flange 122. In particular, the first flange 122 is securely attached to the inner surface 118 because of the large gluing surface area provided by the first plurality of flexible fingers 124. That secure attachment allows the axial engagement surface to provide a structurally and mechanically strong axial retention scheme between the first hub 130 and the first flange 122, particularly for a reel having a plastic hub, a paper core and paper flanges.

The first hub 130 further includes a plurality of support ribs 148 that extend from the locking ring 142 to the dynamic bearing 144. The support ribs 148 provide structural support, which allows for the use of a thinner plastic structure of the first hub 130, having less mass.

Figure 7B:
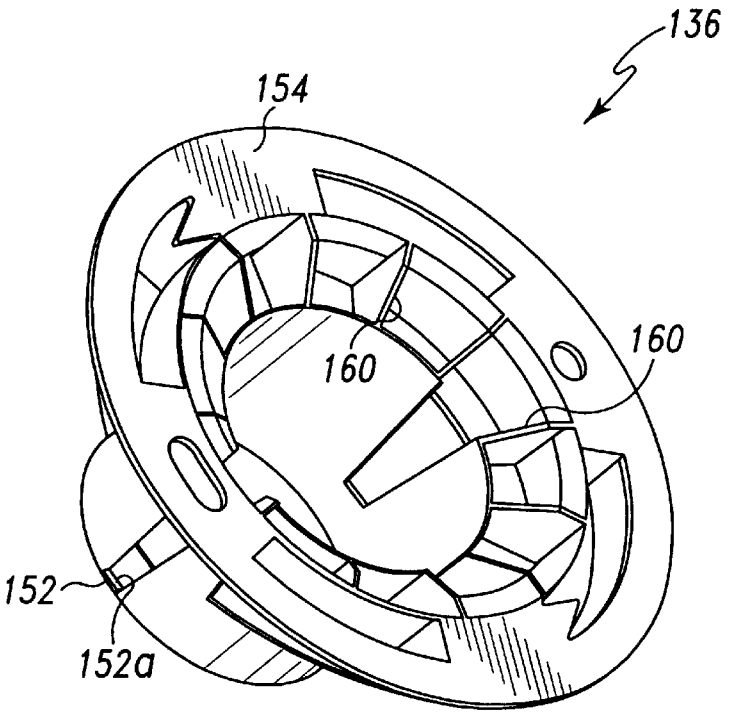
FIGS. 7A and 7B illustrate first and second perspective views of a static bearing for use in the rotating reel assembly of FIG. 5.
Figure 7A:
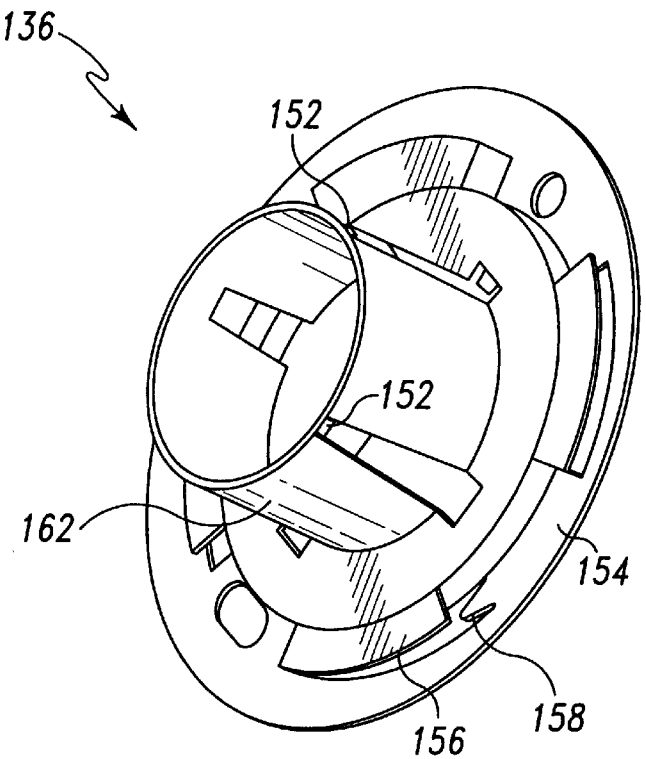

Referring again to FIGS. 5 and 6, the reel 110 is rotatably supported by a frame, and specifically, the first and second end plates 134 and 138, respectively, and the first and second static bearings 136 and 140, respectively. FIGS. 7A and 7B illustrate first and second perspective views of a static bearing, and particularly, the first static bearing 136 or use in the rotating reel assembly 100 of FIG. 5.

Referring to FIGS. 6, 7A, and 7B, the first static bearing 136 includes a disk-shaped bearing flange 154 having an inner radius defined by an axially extending, substantially cylindrical bearing surface 162. The bearing surface 162 is preferably constructed of plastic. Furthermore, the entire first static bearing 136 is preferably constructed of a single piece of molded plastic.

The bearing surface 162 includes a plurality of axial retention barbs 152 disposed on the end of the bearing surface 162 that is axially distant from the bearing flange 154. The bearing surface 162 has a radius slightly smaller than, and is inserted into, the static bearing 144 (see FIGS. 5 and 6). When the rotating reel assembly 100 is fully assembled, an axial retention surface 152*a* on the axial retention barbs 152 engages the static bearing 136 within the core 112 to inhibit axial movement of the static bearing 136 with respect to the dynamic bearing 144 and first hub 130. While the engagement of the axial retention barbs 152 with the static bearing 144 inhibit axial movement, the dynamic bearing 144 may nevertheless freely rotate with respect to the static bearing 136.

Because rotation of the reel 110 with respect to the frame is an important feature of the rotating reel assembly 100, it is desirable to reduce the friction between the dynamic bearing 144 and the static bearing 136. To this end, it may be preferable in some applications to construct the dynamic bearing 144 from a first plastic material and the static bearing 136 from a second plastic material. The use of different plastic materials advantageously reduces the effect of stiction, a phenomenon observed when similar plastics are used in moving parts. Stiction causes moving parts constructed of the same plastic material to require a higher breakaway torque. Accordingly, it may be advantageous to utilize different plastic materials for the dynamic bearing 144 and the top static bearing 136. For example, the dynamic bearing 144 may suitably be constructed from a styretics-based polymer and the static bearing 136 may suitably be constructed from a polyolefin material. In many embodiments, however, the manufacturing costs associated with use of dissimilar plastics may exceed the benefits in the reduction of stiction. As a result, it is often sufficient to construct the dynamic bearing 144 and the static bearing 136 of similar plastic materials. Those of ordinary skill in the art may readily determine whether the use of dissimilar plastics is appropriate for their specific implementation.

The first static bearing 136 further includes a plurality of bearing grips 156. Each of the plurality of bearing grips is connected at one end to the bearing flange 154 and has a surface spaced apart from and substantially parallel to the bearing flange 154. The bearing grips 156 and the bearing flange 154 trap portions of the first end plate 134 therebetween, thereby securing the first static bearing 136 to the first end plate 134. The second static bearing 140 preferably has the same structure as the first static bearing 136. The bearing flange 154 further includes a plurality of locking fingers 158 disposed opposite one or more of the bearing grips 156 and extending upward from the bearing flange 154 toward the bearing grips 156.

The static bearings 136 and 140 employed by the rotating reel assembly 100 in the above embodiment of the present invention facilitate improved convenience in rotating reel assembly usage. Specifically, in addition to the features discussed above, the axial retention barbs 152 secure the reel 100 to the end plates 134 and 138 without requiring a box or other retaining structure. By contrast, prior art reels are not secured to the end plates until they are loaded into the box. As a result, the loaded and often heavy reel must be careful manipulated onto the assembly and into the box. Specifically, the two end plates or fixtures are required to be held in place when the reel assembly is loaded into a box. According to the present invention, the two end plates 134 and 138 need not be held in place or carefully manipulated because the axial retention barbs 152 provide that structural function.

The assembly of the reel 110 is similar to the assembly of the reel 10 of FIGS. 1, 2, and 3. In particular, the first flange 122 is first located adjacent to the first end 114 of the core 112. The first plurality of flexible fingers 124 are then forced axially inward the first end 114 of the core 112. As before, the first hub 130 is used to force the first plurality of flexible fingers 124 into the core 112. Specifically, the first hub 130 is positioned atop the first flange 122 such that the locking ring 146 is in registration with the inner surface 118 of the core 112. The first hub 130 is then forced into the core 112, which causes the first plurality of flexible fingers 124 to bend and engage the inner surface 118.

Typically, an adhesive is first applied to the inner surface 118 proximate the first end 114 of the core 112 prior to insertion of the first hub 130. The compression force caused by insertion of the first hub 130 causes migration of the adhesive through and among the first hub 130, the first plurality of locking fingers 124, and the core 112, thereby creating a secure attachment. Alternatively, adhesive may be applied to the locking finger 126, the first hub 130, or both.

As the first hub 130 is inserted, the locking ring barbs 146 temporarily plastically deform radially inward. Once the first hub 130 is inserted to an axial position in which the locking ring barbs 146 clear the first plurality of fingers 124 within the core 112, the locking ring barbs 146 snap back to engage the axially inward surface of the first plurality of flexible fingers 124 as shown in FIG. 6. The first hub 130 may also be treated with an adhesive to secure the first hub 130 to the first plurality of flexible fingers 124. The second flange 126 and the second hub 132 are secured to the core 112 in substantially the same manner.

The frame is also prepared prior to assembly of the finished reel 110 to the frame. Specifically, the first static bearing 136 is secured to the first end plate 134 and the second static bearing 140 is secured to the second end plate 138. Referring to FIG. 5, the first end plate 134 includes a central opening 164 having an outer perimeter defined by an alternating series of knobs 166 and recesses 168. During assembly, the bearing grips 156 (see FIG. 7A) are inserted into the recesses 168 until the bearing flange 154 (see FIG. 7A) engages the first end plate 134. The first static bearing 136 is then rotated until the bearing grips 156 engage the knobs 166. The bearing grips 156 slightly deform to allow the locking fingers 158 to traverse the knobs 166. Once the first static bearing 136 is rotated such that the knobs 166 traverse the locking fingers 158, the bearing grips 156 snap back to cause the locking fingers 158 to engage the knobs 166. The engagement of the locking fingers 158 and the knobs 166 inhibits back rotation of the first static bearing 136 with respect to the first end plate 134. The second static bearing 140 is secured to the second end plate in substantially the same manner.

The first static bearing 136, after assembly onto the first end plate 134, is then inserted into the first dynamic bearing 144. The first static bearing 136 slightly plastically deforms to allow the axial retention barbs 152 to traverse the first dynamic bearing 144 during insertion. Once the axial retention barbs 152 clear the axially inward edge of the first dynamic bearing 144, the axial retention barbs snap back to engage the first dynamic bearing 144 to inhibit axial movement. The second static bearing 140 is inserted into the second dynamic 144 in substantially the same manner.

It will be understood that the above embodiments and configurations are given by way of example only. Those of ordinary skill in the art may readily devise their own implementations that incorporate the principles of the present invention and fall within the spirit and scope thereof. For example, the axial retention barbs 152 may be replaced by another structure having and axial retention surface to inhibit axial movement of the static bearings with respect to the dynamic bearings.

We claim:

1. An apparatus for supporting wound flexible media comprising:

a core having a first end, a second end, an inner surface, and an outer surface;

a first flange for attaching to the first end of the core, said first flange including a first plurality of flexible fingers, said first plurality of flexible fingers extending axially into the core adjacent to said inner surface proximate the first end;

a second flange for attaching to the second end of the core, said second flange including a second plurality of flexible fingers, said second plurality of flexible fingers extending axially into the core adjacent to said inner surface proximate the second end;

an adhesive interposed between at least one of the first and second plurality of flexible fingers and the inner surface of the core; and at least one locking ring urging the at least one of the first plurality of flexible fingers to the inner surface proximate the first end.

2. The apparatus of claim 1 wherein the adhesive is further interposed between the at least one locking ring and the first plurality of flexible fingers.

3. The apparatus of claim 1 wherein the first flange and second flange are each constructed of corrugated paper.

4. The apparatus of claim 1 wherein the first flange further comprises:

an inner plate having a center hole, said center hole having a radial edge engaging the outer surface of the core proximate the first end; and an outer plate having a fold annulus, said first plurality of flexible fingers extending axially inward said fold annulus, said fold annulus aligned in substantial registration with the inner surface of the core.

5. The apparatus of claim 1 wherein the at least one locking ring is constructed of a paper material.

6. The apparatus of claim 1 wherein the at least one locking ring forms a portion of a hub, and wherein the hub further comprises a flange reinforcement portion extending radially outward from the locking ring and supportably engaging at least a portion of the first flange.

7. The apparatus of claim 1 wherein the at least one locking ring further comprises one or more barbs engaging one or more of the first plurality of locking fingers to inhibit radial movement of the hub with respect to the flange.

8. The apparatus of claim 1 wherein the at least one locking ring is constructed of a single piece of molded plastic.

9. An apparatus for rotatably supporting wound flexible media comprising:

a core having a first end, a second end, an inner surface, and an outer surface;

a first flange for attaching to the first end of the core, said first flange being constructed of corrugated paper and including a first plurality of flexible fingers, said first plurality of flexible fingers extending axially into the core adjacent to said inner surface proximate the first end;

a second flange for attaching to the second end of the core, said second flange being constructed of corrugated paper and including a second plurality of flexible fingers, said second plurality of flexible fingers extending axially into the core adjacent to said inner surface proximate the second end;

a first hub, said first hub including a first dynamic bearing, said first hub further comprising a first locking ring urging at least the first plurality of flexible fingers to the inner surface proximate the first end; and a frame including a first static bearing, said first static bearing rotatably engaging at least the first dynamic bearing.

10. The apparatus of claim 9 wherein the first flange further comprises:

an inner plate having a center hole, said center hole having a radial edge engaging the outer surface of the core proximate the first end; and an outer plate secured to the inner plate and having a fold annulus, said first plurality of flexible fingers extending axially inward said fold annulus, said fold annulus aligned in substantial registration with the inner surface of the core.

11. The apparatus of claim 9 further comprising a second hub having a second dynamic bearing and a second locking ring urging the second plurality of flexible fingers adjacent the inner surface proximate the second end.

12. The apparatus of claim 11 wherein the frame further comprises a second static bearing, said second static bearing rotatably engaging the second dynamic bearing.

13. The apparatus of claim 12 wherein the frame further comprises a first end plate secured to the first static bearing and a second end plate secured to the second static bearing.

14. The apparatus of claim 12 wherein the first and second dynamic bearings are constructed of a first plastic material and the first and second static bearings are constructed of a second plastic material.

15. The apparatus of claim 11 wherein the first static bearing further includes at least one axial retention surface engaging an axially inward edge of the first dynamic bearing to rotatably secure the first static bearing to the first dynamic bearing.

16. The apparatus of claim 9 wherein the first dynamic bearing is constructed of a first plastic material and the first static bearing is constructed of a second plastic material.

17. An apparatus for rotatably supporting wound flexible media comprising:

a core having a first end, a second end, an inner surface, and an outer surface;

a first flange securely attached to the first end of the core;

a second flange securely attached to the second end of the core;

a first hub securely affixed to the first flange, said first hub including a first dynamic bearing having an inner axial edge;

a second hub securely affixed to the second flange, said second hub including a second dynamic bearing;

a frame including a first static bearing, said first static bearing rotatably engaging said first dynamic bearing, said first static bearing further including at least one axial retention surface engaging said inner axial edge to inhibit axial movement of the first static bearing with respect to the first dynamic bearing, said frame including a second static bearing rotatably engaging the second dynamic bearing.

18. The apparatus of claim 17 wherein the second dynamic bearing includes a second inner axial edge and the second static bearing further comprises at least one axial retention surface engaging said second inner axial edge to inhibit axial movement of the second static bearing with respect to the second dynamic bearing.

19. The apparatus of claim 17 wherein the first dynamic bearing is constructed of a first plastic material and the first static bearing is constructed of a second plastic material.

20. An apparatus for supporting wound flexible media comprising:

a core having a first end, a second end, an inner surface, and an outer surface;

a first flange for attaching to the first end of the core, said first flange including a first plurality of flexible fingers, said first plurality of flexible fingers extending axially into the core adjacent to said inner surface proximate the first end;

a second flange for attaching to the second end of the core, said second flange including a second plurality of flexible fingers, said second plurality of flexible fingers extending axially into the core adjacent to said inner surface proximate the second end; and an adhesive interposed between at least one of the first and second plurality of flexible fingers and the inner surface of the core.

21. The apparatus of claim 20 wherein the first flange further comprises a first plate having a fold annulus, said first plurality of flexible fingers extending axially inward said fold annulus, said fold annulus aligned in substantial registration with the inner surface of the core.

22. The apparatus of claim 21 wherein the first flange is constructed of corrugated paper.

23. The apparatus of claim 20 wherein the first flange is constructed of corrugated paper.

* * * * *